US007631877B2

(12) United States Patent
Zara

(10) Patent No.: US 7,631,877 B2
(45) Date of Patent: Dec. 15, 2009

(54) FIREARM TARGETS AND METHODS FOR MANUFACTURING FIREARM TARGETS

(75) Inventor: Robert Joseph Zara, Rocheport, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 341 days.

(21) Appl. No.: 11/339,863

(22) Filed: Jan. 26, 2006

(65) Prior Publication Data

US 2007/0046760 A1 Mar. 1, 2007

(51) Int. Cl.
*F41J 5/00* (2006.01)

(52) U.S. Cl. ..... 273/378; 273/408

(58) Field of Classification Search ..... 273/403–410, 273/378

See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,195,777 | A | 8/1916 | Burtin |
| 1,250,215 | A | 12/1917 | Panos |
| 1,256,255 | A | 2/1918 | Porter |
| 1,367,353 | A | 2/1921 | Craig |
| 1,488,647 | A | 4/1924 | Quinn |
| 1,693,289 | A | 11/1928 | Warren |
| 1,736,244 | A | 11/1929 | Baker |
| 1,902,040 | A | 3/1933 | Meyer |
| 1,907,181 | A | 5/1933 | Fey |

(Continued)

FOREIGN PATENT DOCUMENTS

| | | |
|---|---|---|
| EP | 0624455 | 11/1994 |

(Continued)

OTHER PUBLICATIONS

Birchwood Casey 2005 Catalog, 28 pages.

(Continued)

*Primary Examiner*—Mark S Graham
(74) *Attorney, Agent, or Firm*—Perkins Coie LLP

(57) ABSTRACT

Firearm targets and methods for manufacturing firearm targets are disclosed herein. In one embodiment, a target includes a substrate, a release layer on the substrate, and an ink layer on the release layer such that the release layer is positioned between the ink layer and the substrate. The ink layer at least partially defines a target image. The ink layer has a first section with a first color and a second section with a second color different than the first color.

16 Claims, 6 Drawing Sheets

U.S. PATENT DOCUMENTS

| | | | | | |
|---|---|---|---|---|---|
| 1,927,876 | A | | 9/1933 | Meyer | |
| 1,928,871 | A | | 10/1933 | Swebilius | |
| 2,066,218 | A | | 12/1936 | Morgan | |
| 2,090,930 | A | | 8/1937 | Chubb | |
| 2,100,514 | A | | 11/1937 | Miller | |
| 2,121,982 | A | | 6/1938 | Pugsley | |
| 2,125,353 | A | | 8/1938 | Mattson | |
| 2,216,766 | A | | 10/1940 | Cook | |
| 2,232,743 | A | | 2/1941 | Swenson | |
| 2,297,993 | A | | 10/1942 | Tratsch | |
| 2,331,372 | A | | 10/1943 | Buchanan | |
| 2,378,545 | A | | 6/1945 | Fraser et al. | |
| D147,305 | S | | 8/1947 | Sloan | |
| 2,432,519 | A | | 12/1947 | Garand | |
| 2,451,266 | A | | 10/1948 | Whittemore | |
| 2,455,644 | A | | 12/1948 | Barnes | |
| 2,476,078 | A | | 7/1949 | Banks | |
| 2,479,354 | A | | 8/1949 | Hanson | |
| 2,483,089 | A | | 9/1949 | Ferguson | |
| 2,484,801 | A | | 10/1949 | Anderson | |
| 2,508,951 | A | | 5/1950 | Kazimier | |
| 2,510,380 | A | | 6/1950 | Clifford | |
| 2,517,268 | A | | 8/1950 | Wilson | |
| 2,638,676 | A | | 5/1953 | Callahan | |
| 2,677,207 | A | | 5/1954 | Stewart | |
| 2,701,930 | A | | 2/1955 | Dolan | |
| 2,731,829 | A | | 1/1956 | Wigington et al. | |
| 2,740,530 | A | | 4/1956 | Ponder | |
| 2,753,642 | A | | 7/1956 | Sullivan | |
| 2,774,563 | A | | 12/1956 | Pribis | |
| 2,795,881 | A | | 6/1957 | Bellows | |
| 2,813,376 | A | | 11/1957 | Middlemark | |
| 2,821,117 | A | | 1/1958 | Hultgren | |
| 2,867,931 | A | | 1/1959 | Schreiber | |
| 2,877,689 | A | | 3/1959 | Pribis | |
| 2,894,347 | A | | 7/1959 | Woodcock | |
| 2,924,881 | A | | 2/1960 | Gee | |
| 2,924,904 | A | | 2/1960 | Amsler | |
| 2,924,914 | A | | 2/1960 | Garwood | |
| 2,975,540 | A | | 3/1961 | Lewis | |
| 2,999,788 | A | | 9/1961 | Morgan | |
| 3,011,283 | A | | 12/1961 | Lunn et al. | |
| 3,012,350 | A | | 12/1961 | Wold | |
| 3,023,527 | A | | 3/1962 | Leek et al. | |
| 3,041,938 | A | | 7/1962 | Seabrook | |
| 3,055,655 | A | | 9/1962 | Chelf | |
| 3,060,612 | A | | 10/1962 | Brown et al. | |
| 3,112,567 | A | | 12/1963 | Flanagan | |
| 3,128,668 | A | | 4/1964 | Dicken | |
| 3,163,420 | A | | 12/1964 | Braun | |
| 3,175,456 | A | | 3/1965 | Goodsell | |
| 3,183,617 | A | | 5/1965 | Ruger et al. | |
| 3,206,885 | A | | 9/1965 | Dye | |
| D203,680 | S | | 2/1966 | Benchrest | |
| 3,240,103 | A | | 3/1966 | Lamont | |
| 3,259,986 | A | | 7/1966 | Carr | |
| 3,283,425 | A | | 11/1966 | Boyd | |
| 3,291,317 | A | | 12/1966 | Bowen | |
| 3,292,293 | A | | 12/1966 | Chiasera et al. | |
| 3,320,848 | A | | 5/1967 | Ponsness | |
| 3,323,246 | A | | 6/1967 | Loffler | |
| 3,330,561 | A | * | 7/1967 | Kandel | 273/378 |
| 3,343,411 | A | | 9/1967 | Lee | |
| 3,353,827 | A | | 11/1967 | Dun, Jr. | |
| 3,370,852 | A | * | 2/1968 | Kandel | 273/378 |
| 3,406,969 | A | | 10/1968 | Tisdell et al. | |
| 3,423,092 | A | * | 1/1969 | Kandel | 273/378 |
| D215,311 | S | | 9/1969 | Born | |
| 3,486,752 | A | * | 12/1969 | Colvin et al. | 273/378 |
| 3,499,525 | A | | 3/1970 | Kanter | |
| 3,510,951 | A | | 5/1970 | Dow | |
| 3,513,604 | A | | 5/1970 | Matsunaga et al. | |
| 3,550,941 | A | | 12/1970 | Spiro et al. | |
| 3,556,666 | A | | 1/1971 | Lichenstern | |
| D220,154 | S | | 3/1971 | Irelan | |
| 3,572,712 | A | | 3/1971 | Vick | |
| 3,580,127 | A | | 5/1971 | Lee | |
| 3,583,556 | A | | 6/1971 | Wagner | |
| 3,584,820 | A | | 6/1971 | Butcher, Sr. | |
| 3,587,193 | A | | 6/1971 | Lewis | |
| 3,608,225 | A | | 9/1971 | Manuel | |
| 3,680,266 | A | | 8/1972 | Shiplov | |
| 3,711,955 | A | | 1/1973 | Holt | |
| 3,739,515 | A | | 6/1973 | Koon, Jr. | |
| 3,744,292 | A | | 7/1973 | Michelson | |
| 3,745,875 | A | | 7/1973 | Kennedy et al. | |
| 3,748,950 | A | | 7/1973 | Huntington | |
| 3,764,219 | A | | 10/1973 | Collins | |
| 3,769,758 | A | | 11/1973 | McDonald | |
| 3,813,816 | A | | 6/1974 | Funk | |
| 3,815,270 | A | | 6/1974 | Pachmayr | |
| 3,826,559 | A | | 7/1974 | Berliner et al. | |
| 3,827,172 | A | | 8/1974 | Howe | |
| 3,842,527 | A | | 10/1974 | Low | |
| D233,853 | S | | 12/1974 | Ferrara | |
| 3,877,178 | A | | 4/1975 | Campanelli | |
| 3,885,357 | A | | 5/1975 | Hoyt | |
| 3,893,266 | A | | 7/1975 | Anderson et al. | |
| 3,895,803 | A | * | 7/1975 | Loe | 273/378 |
| 3,899,175 | A | * | 8/1975 | Loe | 273/378 |
| D237,106 | S | | 10/1975 | Baljet et al. | |
| 3,913,746 | A | | 10/1975 | Burton | |
| 3,914,879 | A | | 10/1975 | Taylor, III et al. | |
| 3,947,988 | A | | 4/1976 | Besaw | |
| 3,961,436 | A | | 6/1976 | Hagen et al. | |
| 3,964,613 | A | | 6/1976 | Anderson, Jr. | |
| 3,979,849 | A | | 9/1976 | Haskins | |
| 4,007,554 | A | | 2/1977 | Helmstadter | |
| 4,012,860 | A | | 3/1977 | Auger | |
| 4,021,971 | A | | 5/1977 | McFadden | |
| 4,026,057 | A | | 5/1977 | Cady | |
| 4,027,781 | A | | 6/1977 | Covert | |
| 4,042,242 | A | | 8/1977 | Nicholls et al. | |
| 4,054,288 | A | | 10/1977 | Perrine, Sr. | |
| 4,055,016 | A | | 10/1977 | Katsenes | |
| 4,072,313 | A | | 2/1978 | Murso et al. | |
| 4,076,247 | A | | 2/1978 | Kim et al. | |
| 4,120,108 | A | | 10/1978 | Vickers et al. | |
| 4,120,276 | A | | 10/1978 | Curran | |
| 4,122,623 | A | | 10/1978 | Stice | |
| 4,143,491 | A | | 3/1979 | Blanc | |
| 4,177,608 | A | | 12/1979 | Balz | |
| 4,188,855 | A | | 2/1980 | Alberts | |
| 4,203,600 | A | | 5/1980 | Brown | |
| 4,206,573 | A | | 6/1980 | Hayward | |
| 4,222,305 | A | | 9/1980 | Lee | |
| 4,223,588 | A | | 9/1980 | Simpson | |
| 4,233,748 | A | | 11/1980 | Ford et al. | |
| D257,687 | S | | 12/1980 | Bechtel | |
| 4,266,748 | A | | 5/1981 | Dalton | |
| 4,282,671 | A | | 8/1981 | Wood et al. | |
| D260,650 | S | | 9/1981 | Alviti | |
| D261,794 | S | | 11/1981 | Bechtel | |
| 4,301,625 | A | | 11/1981 | Rampe | |
| 4,312,146 | A | | 1/1982 | Koon, Jr. | |
| 4,332,185 | A | | 6/1982 | Hargrove | |
| 4,333,385 | A | | 6/1982 | Culver | |
| 4,338,726 | A | | 7/1982 | Swailes | |
| 4,340,370 | A | | 7/1982 | Marshall et al. | |
| 4,346,530 | A | | 8/1982 | Stewart et al. | |
| 4,359,833 | A | | 11/1982 | Pachmayr et al. | |
| 4,385,464 | A | | 5/1983 | Casull | |
| 4,385,545 | A | | 5/1983 | Duer | |
| 4,391,058 | A | | 7/1983 | Casull | |

4,392,321 A 7/1983 Bosworth
4,407,379 A 10/1983 Pryor et al.
4,409,751 A 10/1983 Goda et al.
4,438,913 A 3/1984 Hylla
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A * 9/1987 Pilgrim ..... 273/404
4,696,356 A 9/1987 Ellion et al.
4,702,029 A 10/1987 DeVaul et al.
4,723,472 A 2/1988 Lee
4,729,186 A 3/1988 Rieger et al.
4,751,963 A 6/1988 Bui et al.
D297,855 S 9/1988 Ruger et al.
4,776,471 A 10/1988 Elkins
4,790,079 A 12/1988 Meyers
4,799,324 A 1/1989 Nodo
4,807,381 A 2/1989 Southard
4,815,593 A 3/1989 Brown
4,819,359 A 4/1989 Bassett
4,821,422 A 4/1989 Porter
4,823,673 A 4/1989 Downing
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,847 A 1/1990 Cartee et al.
4,896,446 A 1/1990 Gregory
D306,234 S 2/1990 Ferstl et al.
4,903,425 A 2/1990 Harris
4,918,825 A 4/1990 Lesh et al.
4,921,256 A * 5/1990 Gearhart ..... 273/378
4,923,402 A 5/1990 Marshall et al.
4,924,616 A 5/1990 Bell
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,081,783 A 1/1992 Jarvis
5,117,850 A 6/1992 Money
5,123,194 A 6/1992 Mason
5,125,389 A 6/1992 Paff
5,149,900 A 9/1992 Buck
5,180,874 A 1/1993 Troncoso, Jr
5,185,927 A 2/1993 Rivers
5,186,468 A * 2/1993 Davies ..... 273/378
5,188,371 A 2/1993 Edwards
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,235,764 A 8/1993 Perazzi et al.
5,237,778 A 8/1993 Baer
5,247,758 A 9/1993 Mason
5,271,175 A 12/1993 West, III
5,275,890 A * 1/1994 Wolf et al. ..... 428/514
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,328,029 A 7/1994 Chow et al.
5,332,185 A 7/1994 Walker, III
5,335,578 A 8/1994 Lorden et al.
5,344,012 A 9/1994 Matthews
5,358,254 A 10/1994 Yeh et al.
5,361,505 A 11/1994 Faughn
5,367,232 A 11/1994 Netherton et al.
5,370,240 A 12/1994 Hand
5,375,337 A 12/1994 Butler
5,375,377 A 12/1994 Kenton
5,377,437 A 1/1995 Underwood
5,392,553 A 2/1995 Carey
5,402,595 A 4/1995 Tamllos
5,406,733 A 4/1995 Tarlton et al.
5,414,949 A 5/1995 Peebles
D359,392 S 6/1995 Bellington
5,421,115 A 6/1995 McKay
5,433,010 A 7/1995 Bell
5,435,223 A 7/1995 Blodgett et al.
5,442,860 A 8/1995 Palmer
D362,116 S 9/1995 Bellington et al.
D364,080 S 11/1995 Weyrauch
5,481,817 A 1/1996 Parker
5,482,241 A 1/1996 Oglesby
5,486,135 A 1/1996 Arpaio
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,600,913 A 2/1997 Minneman
5,617,666 A 4/1997 Scott
5,628,135 A 5/1997 Cady
5,640,944 A 6/1997 Minneman
5,644,862 A 7/1997 Folmer
5,649,465 A 7/1997 Beebe
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,711,102 A 1/1998 Plaster et al.
D391,616 S 3/1998 Plybon

| | | | | |
|---|---|---|---|---|
| 5,723,183 | A | 3/1998 | Williams et al. | |
| 5,723,806 | A | 3/1998 | Odom | |
| 5,737,865 | A | 4/1998 | Brandl et al. | |
| 5,740,625 | A | 4/1998 | Jenkins | |
| 5,758,447 | A | 6/1998 | Venetz | |
| 5,761,954 | A | 6/1998 | Dvorak | |
| 5,778,589 | A | 7/1998 | Teague | |
| 5,779,527 | A | 7/1998 | Maebashi | |
| 5,811,720 | A | 9/1998 | Quinnell et al. | |
| 5,813,131 | A | 9/1998 | Werre | |
| 5,833,308 | A | 11/1998 | Strong, III et al. | |
| D403,176 | S | 12/1998 | Harper | |
| 5,857,279 | A | 1/1999 | de Oliveira Masina et al. | |
| 5,875,580 | A | 3/1999 | Hill et al. | |
| 5,878,504 | A | 3/1999 | Harms | |
| 5,884,966 | A | 3/1999 | Hill et al. | |
| 5,899,329 | A | 5/1999 | Hu et al. | |
| 5,907,919 | A | 6/1999 | Keeney | |
| 5,913,667 | A | 6/1999 | Smilee | |
| 5,913,668 | A | 6/1999 | Messer | |
| 5,924,694 | A | 7/1999 | Kent | |
| 5,930,932 | A | 8/1999 | Peterson | |
| 5,933,997 | A | 8/1999 | Barrett | |
| 5,933,999 | A | 8/1999 | McClure et al. | |
| 5,959,613 | A | 9/1999 | Rosenberg et al. | |
| 5,970,642 | A | 10/1999 | Martin | |
| 5,974,719 | A | 11/1999 | Simonek | |
| 6,019,375 | A * | 2/2000 | West, Jr. | 273/378 |
| 6,021,891 | A | 2/2000 | Anderson | |
| 6,044,747 | A | 4/2000 | Felts | |
| 6,058,641 | A | 5/2000 | Vecqueray | |
| 6,073,381 | A | 6/2000 | Farrar et al. | |
| 6,086,375 | A | 7/2000 | Legros | |
| 6,110,020 | A | 8/2000 | Rolfi | |
| 6,121,556 | A | 9/2000 | Cole | |
| 6,254,100 | B1 | 7/2001 | Rinehart | |
| 6,260,463 | B1 | 7/2001 | Brand et al. | |
| 6,283,428 | B1 | 9/2001 | Maples et al. | |
| 6,293,041 | B2 | 9/2001 | Weaver | |
| 6,294,759 | B1 | 9/2001 | Dunn, Jr. | |
| 6,305,117 | B1 | 10/2001 | Hales, Sr. | |
| 6,309,476 | B1 | 10/2001 | Ravenscroft et al. | |
| 6,338,218 | B1 | 1/2002 | Hegler | |
| 6,390,294 | B1 | 5/2002 | Fiore, Jr. et al. | |
| 6,439,515 | B1 | 8/2002 | Powers | |
| D471,248 | S | 3/2003 | Jacobs | |
| 6,526,687 | B1 | 3/2003 | Looney | |
| D473,376 | S | 4/2003 | Abate | |
| 6,546,662 | B1 | 4/2003 | Chong | |
| 6,574,899 | B1 | 6/2003 | Mostello | |
| 6,575,469 | B2 | 6/2003 | Love | |
| 6,643,973 | B1 | 11/2003 | Smith | |
| 6,663,298 | B2 | 12/2003 | Haney | |
| 6,688,031 | B2 | 2/2004 | Steele | |
| 6,736,400 | B1 | 5/2004 | Cesternino | |
| 6,813,855 | B2 | 11/2004 | Pinkley | |
| 6,814,654 | B2 | 11/2004 | Rolfi | |
| 6,854,975 | B2 | 2/2005 | Ranzinger | |
| 6,862,833 | B1 | 3/2005 | Gurtner | |
| 6,877,266 | B1 | 4/2005 | Brownlee | |
| 6,883,263 | B1 | 4/2005 | Carrow | |
| 6,931,777 | B1 | 8/2005 | Krien | |
| 6,953,114 | B2 | 10/2005 | Wang et al. | |
| D513,055 | S | 12/2005 | Lahti | |
| 6,978,569 | B2 | 12/2005 | Williamson, IV et al. | |
| D519,183 | S | 4/2006 | Minneman | |
| D521,100 | S | 5/2006 | Morrow | |
| 7,062,979 | B2 | 6/2006 | Day et al. | |
| D524,541 | S | 7/2006 | Cauley | |
| 7,086,192 | B2 | 8/2006 | Deros | |
| 7,134,663 | B1 | 11/2006 | Lowe et al. | |
| 7,152,355 | B2 | 12/2006 | Fitzpatrick et al. | |
| 7,152,358 | B1 | 12/2006 | LeAnna et al. | |
| D540,904 | S | 4/2007 | Werner | |
| 7,207,567 | B1 * | 4/2007 | Brown | 273/409 |
| 7,225,050 | B2 | 5/2007 | Sutula, Jr. | |
| D553,219 | S | 10/2007 | Potterfield et al. | |
| D567,895 | S | 4/2008 | Cauley | |
| 7,357,250 | B2 | 4/2008 | Hagemann et al. | |
| 7,363,740 | B2 | 4/2008 | Kincel | |
| D576,245 | S | 9/2008 | Potterfield et al. | |
| 2002/0113372 | A1 | 8/2002 | Love | |
| 2004/0134113 | A1 | 7/2004 | Deros et al. | |
| 2005/0000141 | A1 | 1/2005 | Cauley et al. | |
| 2005/0011101 | A1 | 1/2005 | Gooder | |
| 2005/0115137 | A1 | 6/2005 | Minneman | |
| 2006/0174532 | A1 | 8/2006 | Popikow | |
| 2006/0175213 | A1 | 8/2006 | Hurt et al. | |
| 2006/0218840 | A1 | 10/2006 | Cauley | |
| 2006/0248775 | A1 | 11/2006 | Wade et al. | |
| 2006/0254111 | A1 | 11/2006 | Giauque et al. | |
| 2007/0029733 | A1 | 2/2007 | Anderson | |
| 2007/0074439 | A2 | 4/2007 | Cauley et al. | |
| 2007/0074440 | A2 | 4/2007 | Cauley | |
| 2007/0113460 | A1 | 5/2007 | Potterfield et al. | |
| 2007/0175077 | A1 | 8/2007 | Laney et al. | |
| 2007/0256346 | A1 | 11/2007 | Potterfield et al. | |
| 2007/0262529 | A1 * | 11/2007 | Gamez et al. | 273/409 |
| 2007/0266610 | A1 | 11/2007 | Coffield | |
| 2007/0294929 | A1 | 12/2007 | Potterfield et al. | |
| 2007/0295197 | A1 | 12/2007 | Potterfield | |
| 2008/0023379 | A1 | 1/2008 | Potterfield et al. | |
| 2008/0023915 | A1 | 1/2008 | Morrow et al. | |
| 2008/0034636 | A1 | 2/2008 | Potterfield et al. | |
| 2008/0041700 | A1 | 2/2008 | Potterfield et al. | |
| 2008/0047189 | A1 | 2/2008 | Potterfield et al. | |
| 2008/0054570 | A1 | 3/2008 | Potterfield et al. | |
| 2008/0061509 | A1 | 3/2008 | Potterfield | |
| 2008/0127815 | A1 | 6/2008 | Yale et al. | |
| 2008/0168697 | A1 | 7/2008 | Potterfield et al. | |
| 2008/0174071 | A1 | 7/2008 | Potterfield et al. | |

FOREIGN PATENT DOCUMENTS

| | | |
|---|---|---|
| GB | 475080 | 11/1937 |

OTHER PUBLICATIONS

Birchwood Casey 2006 Catalog. The date of availability of this catalog is unknown, but is believed to be in Jan. 2006 or later. pp. 5-17 [color copy attached].

Birchwood Casey, "Dirty Bird® Splattering Targets," http://www.birchwoodcasey.com/sport/target_index.asp?categoryID=4&subcat=22, pp. 1-4, internet accessed Jan. 16, 2006.

Birchwood Casey, "Shoot•N•C® Targets," http://www.birchwoodcasey.com/sport/target_index.asp?categoryID=4&subcat=8, pp. 1-8, internet accessed Jan. 16, 2006.

Birchwood Casey, "Target Spots®," http://www.birchwoodcasey.com/sport/target_index.asp?categoryID=4&subcat=12, pp. 1-2, internet accessed Jan. 16, 2006.

Birchwood Casey, "World of Targets®," http://www.birchwoodcasey.com/sport/target_index.asp?categoryID=4&subcat=13, pp. 1-4, internet accessed Jan. 16, 2006.

Champion Target, "Next Generation Paper Targets," http://www.championtarget.com/products/targets/next_generation_targets.aspx, pp. 1-3, internet accessed Jan. 16, 2006.

Champion Traps & Target, 2005 Product Catalog, 11 pages.

U.S. Appl. No. 11/431,956, filed May 10, 2006, Morrow et al.

U.S. Appl. No. 11/505,784, filed Aug. 16, 2006, Cauley.

U.S. Appl. No. 11/679,832, filed Feb. 27, 2007, Cauley et al.

U.S. Appl. No. 11/739,077, filed Apr. 23, 2007, Cauley et al.

U.S. Appl. No. 11/801,341, filed Apr. 23, 2007, Potterfield et al.

U.S. Appl. No. 11/862,821, filed Sep. 27, 2007, Cestermino.

U.S. Appl. No. 11/935,381, filed Nov. 5, 2007, Potterfield.

U.S. Appl. No. 11/937,466, filed Nov. 8, 2007, Potterfield et al.

U.S. Appl. No. 12/037,336, filed Feb. 26, 2008, Potterfield.

U.S. Appl. No. 12/117,668, filed May 8, 2008, Potterfield et al.

U.S. Appl. No. 12/172,848, filed Jul. 14, 2008, Cestermino et al.
U.S. Appl. No. 12/177,032, filed Jul. 21, 2008, Potterfield et al.
"American Rifleman: What to do about recoil," LookSmart, http://www.findarticles.com/p/articles/mi_qa3623/is_199907/ai_n8861959/print, pp. 1-4 [Internet accessed on Jan. 4, 2006].
"Cleaning Cradles: Sinclaire Cleaning Cradles," p. 21, The date on which the Sinclair Folding Cleaning Cradle was first on sale is not known, but is believed to be circa 2004.
"Decker Rifle Vise," 1 page, the date on which the Decker Rifle Vise was first on sale is not known but is believed to be circa 2004.
Amazon.com, "Eforcity Magnetic Screwdriver Set w/15 bits; Great for Cellphones, Computers; Includes: T6, Torx, Security Torx, Philips, Slotted, Spanner, Tri-Wing, Bent Pry Tool, Round Awl, Reset Pin for Game Boy Advance, Nintendo WII, DS Lite, NDS, Apple TV," 1 page [Internet accessed on Sep. 18, 2007].
Battenfeld Technologies, Inc., "Gun Vise," Tipton Gun Cleaning Supplies, Battenfeld Technologies, Inc. 2004 Catalog, p. 32, Product No. 782-731, 2 pgs.
"The Grabber and Hustler '76," MEC—Mayville Engineering Company, Inc., 2 pgs., undated.
1shop2.com "Hoppe's Gunsmith's Fully Adjustable Bench Vise," http://www.1shop2.com/outdoor_sports/Hoppe's—Gunsmith's-Fully-Adj ..., 3 pgs, the date on which the Hoppe's Gunsmith's Fully Adjustable Bench Vise was first on sale is not known, but is believed to be circa 2004.
AcuSport, Outdoor Sporting Products, 3 pgs., undated.
Battenfeld Technologies, Inc., "Steady Rest Portable Shooting Rest," 1 page [Internet accessed Jan. 25, 2006].
Birchwood Casey 2006 Catalog, pp. 5-17.
Birchwood Casey, "Dirty Bird® Splattering Targets," http://www.birchwoodcasey.com/sport/target_index.asp?categoryID=4&subcat=22, pp. 1-4 [Internet accessed Jan. 16, 2006].
Birchwood Casey, "Shoot•N•C® Targets," http://www.birchwoodcasey.com/sport/target_index.asp?categoryID=4&subcat=8, pp. 1-8 [Internet accessed Jan. 16, 2006].
Birchwood Casey, "Targets Spots®," http://www.birchwoodcasey.com/sport_index.asp?categoryID=4&subcat=12, pp. 1-2 [Internet accessed Jan. 16, 2006].
Birchwood Casey, "World of Targets®," http://www.birchwoodcasey.com/sport/target_index.asp?categoryID=4&subcat=13, pp. 1-4 [Internet accessed Jan. 16, 2006].
Brownells, Inc., "Brownells Magna-Tip Screwdriver," Brownells Catalog No. 54, 2001-2002, p. 151.
Brownells, Inc., "Brownells Magna-Tip Super-Sets," Brownells Catalog No. 54, 2001-2002, p. 153.
Brownells, Inc., Catalog No. 41, 1988-1989, 3 pgs.
Brownells, Inc., Catalog No. 47, 1994-1995, 2 pgs.
Brownells, Inc., Catalog No. 57, 2004-2005. 2 pgs.
Brownells, Inc., Sight Base Cutters, Faxed Dec. 17, 2003, 1 page.
B-Square, Pro Gunsmith Screwdriver Set, B-Square Mounts Tools Accessories Product Catalog, p. 23, date unknown.
Cabela's Master Catalog, Fall 2002, Edition II, p. 416.
Cabela's Master Catalog, Fall 2003, Late-Season Edition, p. 416.
Cabela's, "HySkore Sighting System and Cleaning Vise," The date on which the HySkore Sighting System and Cleaning Vise was first on sale is not known, but is believed to be circa Jan. 2005, however, a prototype of this product may have been shown to buyers at Cabela's circa Aug. 2004, 1 page.
Caldwell Insta-View™ 4" Targets.
Caldwell™ Shooting Supplies, Targets & Target Accessories, InstraView™ Targets, 1 page.
Californiavarmintcallers.com—Forum, http://californiavarmintcallers.com/community/modules/newbb/viewtopic.php?topic_id=10&forum=9&PHPSESSID=074ed8c7..., pp. 1-4 [Internet accessed Jan. 16, 2006].
Champion Target, "Next Generation Paper Targets," http://www.championtarget.com/products/targets/next_generation_targets.aspx, pp. 1-3, [Internet accessed on Jan. 16, 2006].
Champion Traps & Target, 2005 Product Catalog, 12 pgs.
Ellett Brothers, Rests & Gun Vises, pp. 621-622, date unknown.
Lohman Sight Vise, 4 pages product photographs, the date on which the Lohman Site Vise was first on sale is not known, but is believed to be circa 2004.
Milek, B., "Handloading for Hunting New Products from RCBS, Lee, Accurate Arms," Peterson's Hunting, Mar. 1985, p. 21.
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].
Lahti Company Brochure, "Rock Solid Hold," Rifle Evaluator, http://www.lathicompany.com/Forms/EvaluatorBrochure2.jpg, 2 pgs. [Internet accessed Jan. 16, 2006].
Lahti Company Brochure, "Rifle Evaluator: No Pain, No Fear, No Flinching, No Body Movement," www.lahticompany.com, 2 pgs, Undated.
Lee Precision, Inc., "The World's Fastest Handloading Press . . . Lee Progressive 1000," 1985 Catalog, pp. 1-15.
Lee Precision, Inc., "Load-All," 1 page.
Lyman, "A History of Lyman Metallic Reloading," Reloading Handbook, 46th Edition, pp. 10-31.
Lyman, "Introduction to Reloading," Reloading Handbook, 46th Edition, pp. 170-203.
Carmichael, J.," Reloading for Accuracy," Lyman Reloading Handbook, 46th Edition, pp. 68-77.
Midway USA, "Chapman 27-Piece Deluxe Screwdriver Set," Master Catalog #2 and Reference Guide, 2004, Product # 510-765, p. 440.
Midway USA, "Pachmayr Professional Screwdriver Set," Master Catalog #2 and Reference Guide, 2004, Product #776-936, p. 448.
Midway USA, "Wheeler Engineering Space-Saver Gunsmithing Screwdriver Set," Master Catalog #2 and Reference Guide, 2004, Product #297-593, p. 453.
Midway USA. "Tipton Range Box with Ultimate Rifle, Handgun Cleaning Kit (No Solvents)," http://www.rnidwayusa.com/rewriteaproduct/135086, The date on which the Tipton Range Box was first on sale is not known, but is believed to be circa 2004, 2 pages.
MTM Case-Gard, "Gun Maintenance Centers," http://www/mtmcase-gard.com/products/shooting/gunm.html, The date on which the MTM Gun Maintenance Center was first on sale is not known, but is believed to be circa 2004, 2 pages [Internet accessed Oct. 11, 2006].
MTM Case-Gard, "Rifle rest and pistol shooting rest," http://www/mtmcase-gard.com/products/shooting/shoo.html, The date on which the MTM Site-In-Clean was first on sale is not known, but is believed to be circa 2004, 3 pages [Internet accessed Oct. 11, 2006].
MTM Case-Gard, "MTM Shoulder-Gard Rifle Rest," Cover Photo for Rest, p. 2, date unknown.
Caldwells Insta-View 4" Targets, 1 page [product photo].
CV-500, 3 pages [product photos].
Dillon Precision CV-500 Cartridge Case Vibratory Cleaner, 6 pages [product photos].
Lyman Hornady Case Tumbler, 3 pages [product photos].
Lyman Turbo 600 Tumbler, 3 pages [product photos].
Lyman Turbo Pro 1200 Tumbler, 2 pages [product photos].
Auto-Flo Lyman Turbo 1200 Tumbler, 2 pages [product photos].
RCBS Automatic Primer Tool, pp. 68-71, undated.
"Reloading Manual Number Ten for Rifle and Pistol, The Cartridge Components," SPEER Omark Industries, pp. 28-54.
"Shotshell reloading with a GRABBER 76," MEC—Mayville Engineering Company, Inc., pp. 1-12.
Sweeney, P "Gunsmithing: Measure Headspace, Peterson's Rifleshooter," http://www.rifleshootermag.com/gunsmithing/headspace_0612/, 4 pages [Internet Accessed Dec. 11, 2004].
Tenex Precision Co., "Recoil A-Rest-R," 4 pages, date unknown [product photos].
"Plano Shooters Case, Brown Camo," The Sportman's Guide, http://www.sportmansguide.com/cb/cb.asp?a=148225, The date on which the Plano Shooters Case was first on sale is not known but is believed to be circa 2004, 3 pages [Internet accessed on Oct. 11, 2006].
Precision Shooting, Inc., Bald Eagle Front Rest, The Accurate Rifle, vol. 6, Issue No. 4, May 2003, p. 47.
Sinclair International, Sinclair Shooting Rests, Products for the Precision Shooter, 2002, Issue No. 2002-B pp. 76-78.

Device manufactured by Shooter's Ridge, a division of ATK, and available at least by late 2005, 1 page.
"Uncle Bud'S Udder Bag," http:www.unclebudscss.com/pages/Udder%20Bags.html, 2 pgs. [Internet accessed on Feb. 14, 2006].
"Uncle Bud'S Bull Bags," http:www.unclebudscss.com/pages/Bulls%20bags.html, 2 pgs. [Internet accessed on Feb. 14, 2006].
Millett, "BenchMaster Shooting Rests," 1 page, Undated.
Protektor Model, "The Original Leather Rifle and Pistol Rest," http://www.protektormodel.com/, 12 pages [Internet accessed on Feb. 14, 2006].
Edgewood Shooting Bags Catalog, http://www.edgebag.com/catalog.php, 7 pages [Internet accessed on Feb. 14, 2006].
Canadian Camo, "Gun Rest," http://media5.magma.ca/www.canadiancamo.com/catalog/product_info.php?products_id=..., 2 pages [Internet accessed on Feb. 13, 2006].
Caldwell Shooting Supplies, 2006 Catalog, pp. 18, 5, 12, 14 and 15.
Cabela's, "Secure Bench Rest," http://www.cabelas.com/cabelas/en/templates/links/link.jsp;jsessionid=4F0LP0OW2HMRLLAQBBISCOF.., © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product&cmCat=.., © 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a&type=product&cmCat=, © 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, © 1996-2008, 2 pages [Internet accessed on Aug. 6, 2008].
Cabela's, "Sure Shot Shooting Vise/Rest," http://www.cabelas.com/cabelas/en/templates/product/standard-item.jsp?id=00348272277..., © 1996-2008, 2 pages [Internet accessed on Jul. 15, 2008].
Cabela's, "BenchBuddy® Gun Rest," http://www.cabelas.com/cabelas/en/templates/links/link.jsp?id=0005819221954a&type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id =0005817227855a&type=product&cmCat=,© 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Hyskore® Dangerous Game™ Machine Rest," http://www.cabelas.com/cabelas/en/templates/links/link.jsp?id=0044091228556a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, © 1996-2008, 2 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651 &t11082005, 2005, 4 pages [Internet accessed on Aug. 6, 2008 ].
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooters Ridge Steady Point Rifle Shooting Rest and Vise," http://www.midwayusa.com/eproductpage.exe/showproduct?saleitemid=341095&t=11082005, 2005, 4 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitem id=838848&t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].
MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin..., 15 pages [Internet accessed on Jul. 21, 2008].
Basspro.com, "Bass Pro Shops Outdoors Online: Offering the best in Fishing, Hunting and Outdoor Products," http://www.basspro.com/webapp/wcs/stores/servlet/Product__10151__-1__10001__95064__SearchResults, 2 pages [Internet accessed on Aug. 6, 2008].
Amazon.com, "CTK® P3 Ultimate Shooting Rest," Sports & Outdoors, http://www.amazon.com/CTK%C2%AE-P3-Ultimate-Shooting-Rest/dp/..., 1 page [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin..., 1 page [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/B0.., 1 page [Internet accessed on Jul. 22, 2008].
CTK Precision, All Products, http://www.ctkprecision.com/index.asp?PageAction=VIEWCATS&Cate.., 3 pages [Internet accessed on Jul. 22, 2008].
CTK Precision, "P3 Ultimate Shooting Rest," http://www.ctkprecision.com/index.asp?PageAction=VIEWPROD&ProdOID=2, 3 pages [Internet accessed on Jul. 18, 2008].
Big Boy Gun Toys, "Shooting Rest," http://www.bigboyguntoys.com/shootingrest.htm, 1 page [Internet accessed on Jul. 18, 2008].
Boyt Harness Company, Product Catalog, http://www.boytharness.com/catalog/index.php?cPath=22, 2 pages [Internet accessed on Jul. 21, 2008].
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].

"Gun Rest—Shooting Rest—Rifle Rests," http://www.jexploreproducts.com/gunrests-shootingrests.htrn, 6 pages [Internet accessed Jul. 18, 2008].
E. Arthur Brown Company, "A Shooting Rest that Really Works..," http://www.eabco.com/TargetShooting01.html, © 2007-2008, 1 page [Internet accessed Jul. 18, 2008].
MacksPW.com, "Desert Mountain Bench Master Rifle Rest," http://www.macksqw.com/Item—i-DESBM1, © 2004-2008, 1 page [Internet accessed Jul. 22, 2008].
Hyskore, "Rest—Dangerous Game Machine Rest," Hyskore Rest, Professional firearm rests, http://www.hyskore.com/rests.htm, 2 pages [Internet accessed Jul. 21, 2008].
Shooters Ridge, "Shooting Rest with Gun Vise," http://www.shootersridge.com, 1 page [Internet accessed Jul. 17, 2008].
Shooters Ridge, "Deluxe Rifle Rest," http://www.shootersridge.com, 1 page [Internet accessed Jul. 21, 2008].
Chastain, R. "Load 'em Up!" About.com: Hunting/ Shooting, http://hunting.about.corn/od/reloadinfo/a/aaloademup_2htm, 6 pages [Internet accessed on Aug. 31, 2007].
Harris, J. et al., "The Art and Science of Annealing," http://www.6mmbr.com/annealing.html, © 2005, 13 pages [Internet accessed on Aug. 13, 2007].
Cork Industries, Inc., "Double Bumping Coating Applications," Cork Tech TalkNews, Feb. 1997, 2 pages.
Grafix® Plastics, http://www.grafixplastics.com/plastic_film_g.asp?gclid=CK-5-_7gnY4CFRVNhgodjFhfSQ, 29 pages [Internet accessed on Aug. 30, 2007].
International Search Report and Written Opinion; International Patent Application No. PCT/US07/76440; Filed: Aug. 21, 2007; Applicant: Battenfeld Technologies, Inc.; Mailed on Sep. 30, 2008.
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Non-Final Office Action; U.S. Appl. No. 10/865,595; Mailed on Jun. 7, 2006, 8 pages.
Final Office Action; U.S. Appl. No. 10/865,595; Mailed on Apr. 3, 2007, 10 pages.
Non-Final Office Action; U.S. Appl. No. 11/339,863; Mailed on Sep. 23, 2008, 7 pages.
Non-Final Office Action; U.S. Appl. No. 11/206,430; Mailed on May 21, 2007, 12 pages.
Final Office Action; U.S. Appl. No. 11/206,430; Mailed on Oct. 29, 2007, 13 pages.
Non-Final Office Action; U.S. Appl. No. 11/206,430; Mailed on May 14, 2008, 10 pages.
Non-Final Office Action; U.S. Appl. No. 11/271,100; Mailed on Mar. 26, 2008, 9 pages.
Final Office Action; U.S. Appl. No. 11/271,100; Mailed on Sep. 22, 2008, 8 pages.
Non-Final Office Action; U.S. Appl. No. 11/311,530; Mailed on Feb. 13, 2007, 10 pages.
Non-Final Office Action; U.S. Appl. No. 11/505,784; Mailed on Dec. 26, 2007, 14 pages.
Non-Final Office Action; U.S. Appl. No. 11/507,683; Mailed on Sep. 18, 2008, 8 pages.
Non-Final Office Action; U.S. Appl. No. 11/679,136; Mailed on Aug. 18, 2008, 6 pages.
Non-Final Office Action; U.S. Appl. No. 11/679,136; Mailed on Aug. 28, 2008, 8 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
Non-Final Office Action; U.S. Appl. No. 11/853,763; Mailed on Dec. 22, 2008 (6 pages).

* cited by examiner

FIREARM TARGETS AND METHODS FOR MANUFACTURING FIREARM TARGETS

TECHNICAL FIELD

The present invention is related to firearm targets and methods for manufacturing firearm targets.

BACKGROUND

Military personnel, law enforcement officers, hunters, and sport shooters use firearm targets to hone their marksmanship. Target shooting enables shooters to improve their accuracy and precision at a shooting range or other controlled environment. Conventional targets include a paper substrate and a target image printed directly onto the paper substrate. The target image often includes a bull's eye with concentric rings. One drawback of conventional targets is that it is difficult for shooters to see the bullet holes from a distance. This problem is particularly acute in darker environments and with smaller caliber rounds. As a result, shooters typically walk to the target and inspect the target at close range after firing several rounds. This process is time-consuming and may disrupt a shooter's concentration and rhythm.

One existing approach to improve the visibility of bullet holes in targets includes forming the bull's eye of the target with a layer of detachable dark ink. When a bullet strikes the bull's eye, the dark ink layer fractures around the point of impact and the fractured portion of the layer detaches from the target. Because the detached portion of the dark ink layer is larger than the bullet hole, an adjacent surface of the paper substrate is exposed. The contrast between the surrounding dark ink and the exposed paper substrate enables a shooter to identify the point of impact. One problem with this approach, however, is that not all shots strike the bull's eye, and shots that miss the bull's eye are difficult to see.

Another existing approach to improve the visibility of bullet holes in targets includes covering the entire target with the layer of detachable dark ink. Although this approach improves the visibility of all shots that strike the target, these targets are disfavored by many shooters who prefer targets with a traditional bull's eye configuration. Accordingly, there is a need to improve the visibility of bullet holes in firearm targets.

DETAILED DESCRIPTION

A. Overview

Figure 1A:
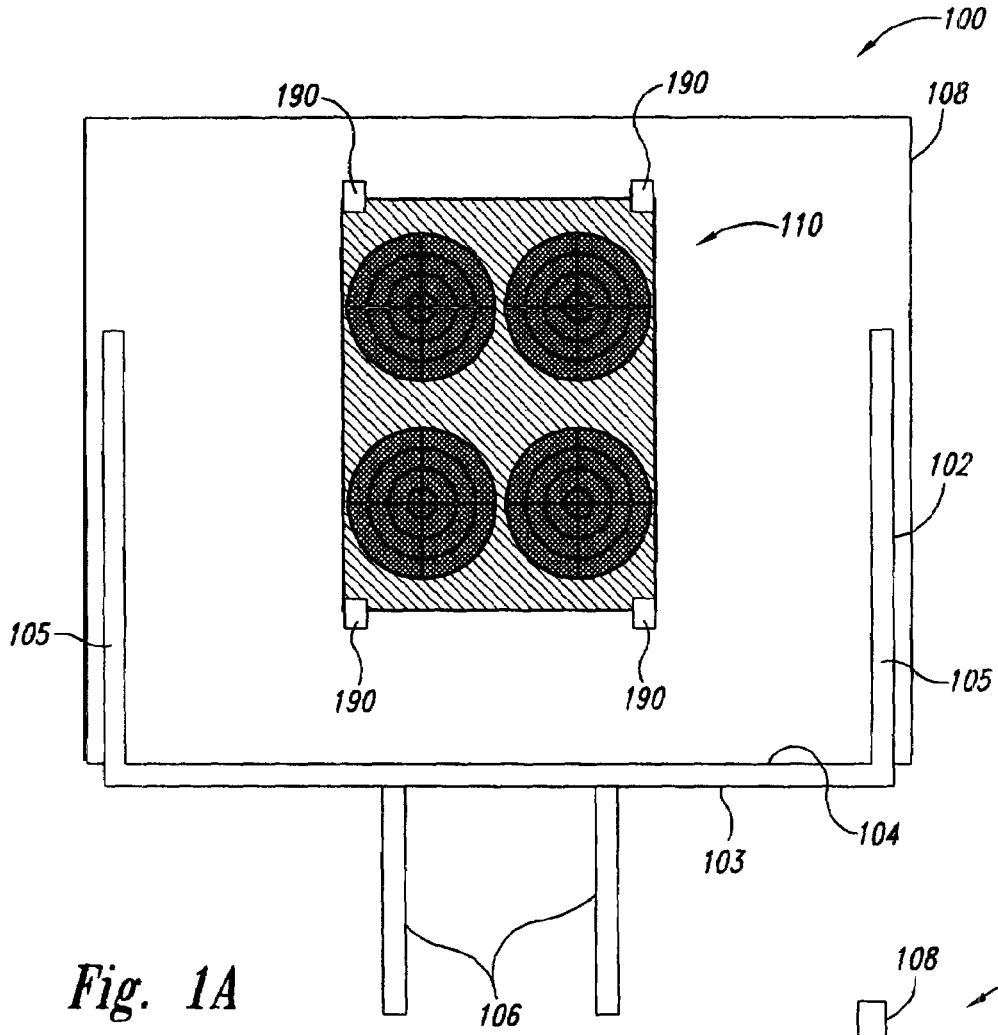
FIG. 1A is a schematic front view of a target assembly in accordance with one embodiment of the invention.

The following disclosure describes several embodiments of firearm targets and methods for manufacturing firearm targets. In one embodiment, a target includes a substrate, a release layer on the substrate, and an ink layer on the release layer such that the release layer is positioned between the ink layer and the substrate. The ink layer at least partially defines a target image, and has a first section with a first color and a second section with a second color different than the first color. For example, the first section can be black and the second section can be orange, red, brown, or another suitable color. The target may further include a synthetic layer between the ink layer and the substrate.

In another embodiment, a target includes a substrate, a first ink layer covering at least part of the substrate, and a second ink layer carried by the substrate. The second ink layer includes (a) a first section having a first color and covering at least part of the first ink layer, and (b) a second section having a second color different than the first color. The second ink layer is configured so that the impact of a firearm projectile (e.g., a bullet) detaches a portion of the second ink layer from the substrate and exposes a surface of the substrate and/or the first ink layer. The first ink layer may also include a first section having a third color different than the first and second colors, and a second section having a fourth color different than the first, second, and third colors.

In another embodiment, a target includes a substrate and an ink layer carried by the substrate. The ink layer includes a first section having a first color and a second section having a second color different than the first color. The target is configured such that penetration of a projectile removes a portion of the ink layer and exposes a surface adjacent to the ink layer. The target may further include a release layer positioned between the ink layer and the substrate, or a release agent in the ink layer.

Another aspect of the invention is directed to methods for manufacturing firearm targets. In one embodiment, a method includes forming a release layer on a substrate and printing an ink layer on the release layer with the ink layer at least partially defining a target image. The ink layer includes a first section with a first color and a second section with a second color different than the first color. The method may further include (a) depositing a second ink layer between the release layer and the substrate, and/or (b) disposing an adhesive layer on the substrate opposite the release layer.

Specific details of several embodiments of the invention are described below with reference to firearm targets that are attached to a backing member with an external adhesive or fasteners, but in other embodiments the targets can have an integral adhesive layer on the back side to attach the targets to backing members Several details describing well-known structures or processes often associated with fabricating firearm targets are not set forth in the following description for purposes of brevity and clarity. Also, several other embodiments of the invention can have different configurations, components, or procedures than those described in this section. A person of ordinary skill in the art, therefore, will accordingly understand that the invention may have other embodiments with additional elements, or the invention may have other embodiments without several of the elements shown and described below with reference to FIGS. 1A-8. Where the context permits, singular or plural terms may also include the plural or singular term, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features and/or other types of features and components are not precluded.

B. Embodiments of Target Assemblies

Figure 1B:
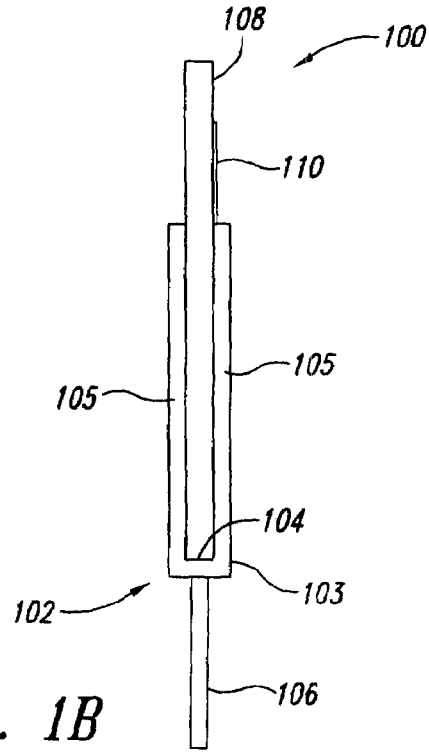
FIG. 1B is a schematic side view of the target assembly of FIG. 1A.

FIG. 1A is a schematic front view and FIG. 1B is a schematic side view of a target assembly 100 in accordance with one embodiment of the invention. The target assembly 100 includes a target stand 102, a backing member 108 carried by the target stand 102, and a target 110 attached to the backing member 108. The illustrated target stand 102 includes a base 103, a plurality of arms 105 projecting generally upward from the base 103, and a plurality of legs 106 projecting generally downward from the base 103. The base 103 includes a surface 104 for supporting the backing member 108, and the arms 105 are arranged in pairs at opposite ends of the base 103. As shown in FIG. 1B, the arms 105 in each pair are spaced apart by a gap corresponding to the thickness of the backing member 108. The legs 106 are configured for insertion into the ground so that the target assembly 100 can be used in a field or other suitable location. In other embodiments, the target stand 102 can have a different configuration, or the target assembly 100 may not include a target stand.

The backing member 108 can be placed on the target stand 102 by sliding the backing member 108 between the arms 105. The backing member 108 can be a corrugated plastic structure, a piece of paper stock, or other suitable member to which one or more targets 110 can be attached. Although the illustrated target 110 is attached to the backing member 108 with strips of tape 190, in other embodiments the target 110 can be attached to the backing member 108 with glue, staples, nails, pins, or other suitable fastening devices. Alternatively, the back side of the target 110 can include an integral adhesive layer for attaching the target 110 to the backing member 108. In other embodiments, the target assembly 100 may not include a backing member, or the backing member 108 can have a different configuration.

C. Embodiments of Targets

Figure 2:
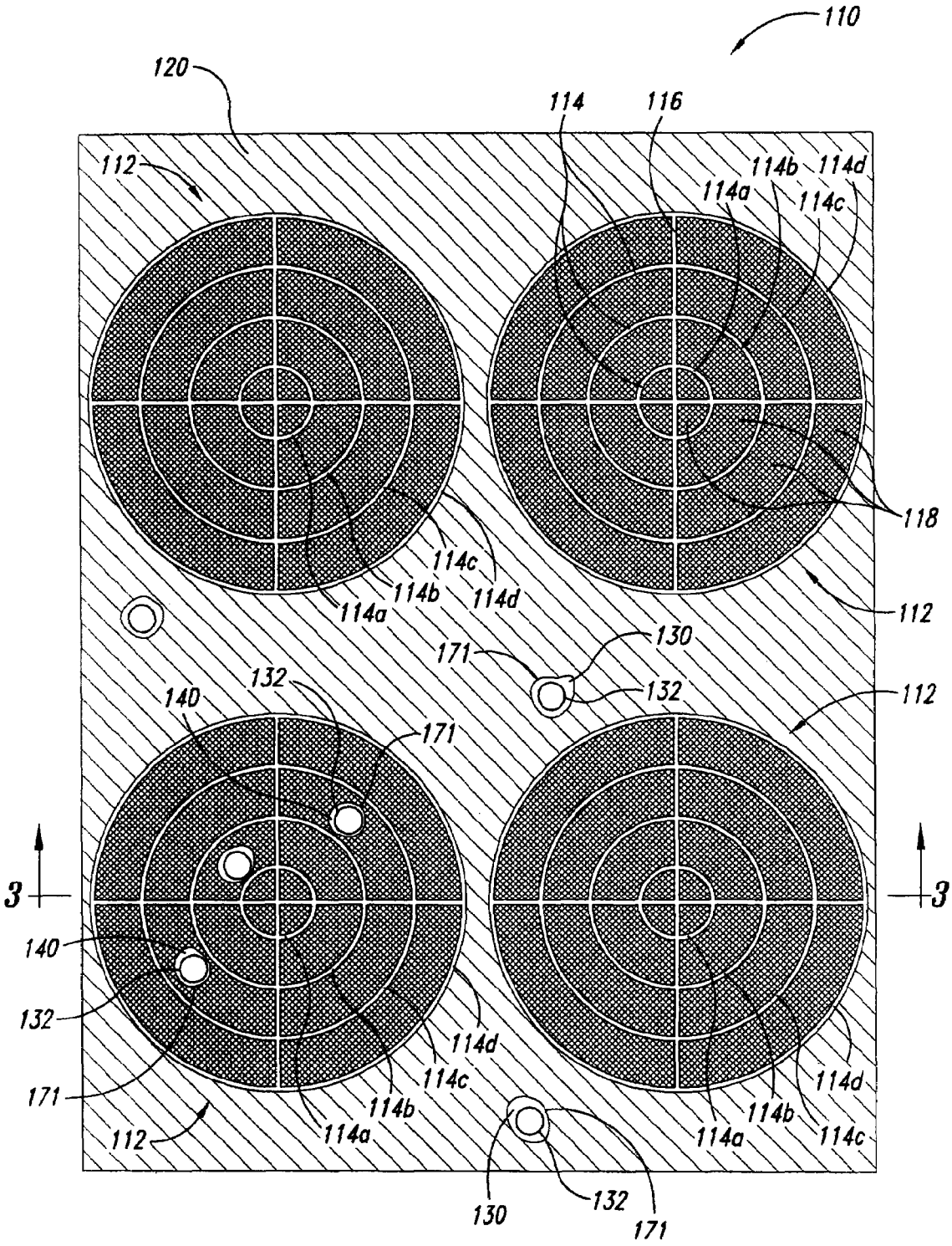
FIG. 2 is a schematic front view of the target illustrated in FIG. 1.

FIG. 2 is a schematic front view of the target 110 illustrated in FIG. 1. The target 110 includes a plurality of target images 112 and a field 120 between the target images 112. The individual target images 112 include a plurality of concentric rings 114 (identified individually as 114*a-d*), a cruciform 116 centered relative to the rings 114, and a plurality of arcuate segments 118 positioned between adjacent rings 114 and between an inner ring 114*a* and the cruciform 116. In the illustrated embodiment, the concentric rings 114 and the cruciform 116 have a first color, the arcuate segments 118 have a second color different than the first color, and the field 120 has a third color different than the first and second colors. For example, in several applications, the rings 114 and the cruciform 116 are fluorescent yellow, the arcuate segments 118 are black, and the field 120 is orange. In additional embodiments, however, the first, second, and/or third colors can include brown, red, white, green, and other suitable colors. In either case, the contrast between the different first, second, and third colors enables a shooter to easily identify the target image 112. In other embodiments, such as the embodiments described below with reference to FIGS. 7 and 8, the target 110 can include more or less than four target images 112, and some of the target images can have different configurations. For example, the target images may not include the concentric rings 114, the cruciform 116, and/or the arcuate segments 118.

Figure 3:
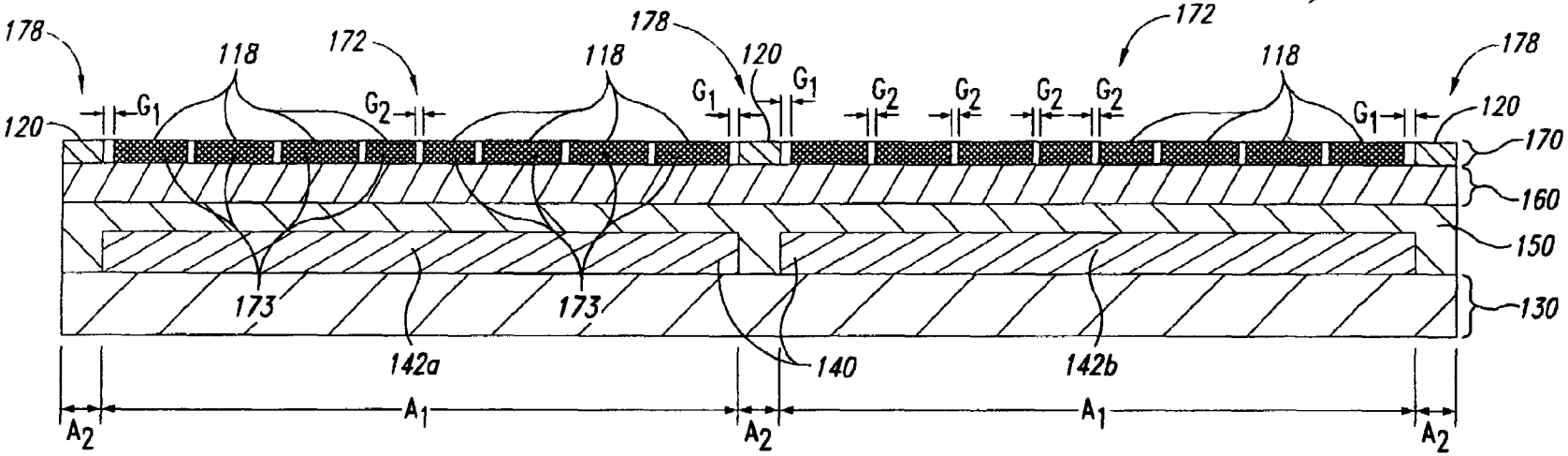
FIG. 3 is a schematic side cross-sectional view of the target taken substantially along line 3-3 of FIG. 2.

FIG. 3 is a schematic side cross-sectional view of the target 110 taken substantially along line 3-3 of FIG. 2. The illustrated target 110 includes a substrate 130, a first ink layer 140 formed on the substrate 130, a synthetic layer 150 deposited on the substrate 130 and the first ink layer 140, a release layer 160 formed on the synthetic layer 150, and a second ink layer 170 disposed on the release layer 160. The substrate 130 can be an organic material such as paper or an inorganic material such as mylar. The substrate 130 may also have a different color than the rings 114 (FIG. 2), the arcuate segments 118, and/or the field 120. For example, the substrate 130 may be white, green, red, brown, or another suitable color. The illustrated substrate 130 includes a plurality of first areas $A_1$ aligned with corresponding target images 112 (FIG. 2) and a second area $A_2$ aligned with the field 120.

The illustrated first ink layer 140 includes a plurality of sections 142 (only two shown and identified individually as 142*a-b*) covering corresponding first areas $A_1$ of the substrate 130. As a result, the first ink layer 140 does not cover the second area $A_2$ of the substrate 130. In other embodiments, however, the first ink layer 140 can cover the first and second areas $A_1$ and $A_2$ of the substrate 130. In either case, the color of the first ink layer 140 corresponds to the color of the rings 114 and the cruciform 116 because the rings 114 and the cruciform 116 are portions of the first ink layer 140 that are visible through the other layers.

The illustrated synthetic and release layers 150 and 160 extend across the target 110 over the first and second areas $A_1$ and $A_2$ of the substrate 130. The synthetic and release layers 150 and 160 can be generally transparent so that the first ink layer 140 and the second area $A_2$ of the substrate 130 are visible through the layers 150 and 160. The synthetic layer 150 can be made of an elastically deformable material that is configured to stretch when a projectile contacts the layer 150. For example, the synthetic layer 150 can be composed of polypropylene, synthetic varnish, or other suitable materials. In other embodiments, a natural material such as natural resin or varnish can also be used. The release layer 160 is configured to inhibit the second ink layer 170 from adhering to the target 110 such that a portion of the second ink layer 170 freely detaches from the target 110 when a projectile (e.g., bullet) strikes the target 110. The release layer 160 does not, however, cause the entire second ink layer 170 to detach when a projectile strikes the target 110. Rather, the release layer 160 allows the areas of second ink layer 170 outside of the strike zone to remain adhered to the target 110 such that only the portion of the second ink layer 170 proximate to the point of impact is removed from the target 110.

The synthetic and release layers 150 and 160 operate together to detach a portion of the second ink layer 170 surrounding the point at which a projectile strikes the target 110. For example, as the projectile passes through the target 110, the projectile stretches the synthetic layer 150, which fractures an adjacent region the second ink layer 170. The release layer 160 enables the fractured portion of the second ink layer 170 to detach from the target 110 and form an opening 171 (FIG. 2) in the second ink layer 170. As best seen in FIG. 2, the opening 171 is larger than a hole 132 formed by the projectile in the substrate 130 and/or the first ink layer 140. As a result, the opening 171 exposes a section of the substrate 130 or the first ink layer 140.

The illustrated second ink layer 170 includes (a) a plurality of first sections 172 aligned with corresponding first areas $A_1$ of the substrate 130, and (b) a second section 178 aligned with the second area $A_2$ of the substrate 130. The first and second sections 172 and 178 of the second ink layer 170 define the target images 112 and the field 120, respectfully. Specifically, the individual first sections 172 include a plurality of discrete arcuate portions 173 with external surfaces that form the arcuate segments 118 (best seen in FIG. 2) of the target image 112 (FIG. 2). The second section 178 surrounds the first sections 172 and has an external surface that forms the field 120 (best seen in FIG. 2). In the illustrated embodiment, the first sections 172 are spaced apart from the second section 178 by gaps $G_1$, which expose portions of the first ink layer 140. These exposed portions of the first ink layer 140 form the outer rings 114*d* (FIG. 2) of the target images 112. Adjacent arcuate portions 173 of the individual first sections 172 are spaced apart from each other by gaps $G_2$, which expose other portions of the first ink layer 140. These exposed portions of the first ink layer 140 form the inner concentric rings 114*a-c* and the cruciform 116 of the target images 112. In other embodiments, the first and second sections 172 and 178 of the second ink layer 170 may be spaced apart from the substrate 130 by different distances. For example, the first sections 172 can be disposed over the first and second area $A_1$ and $A_2$ of the substrate 130, and the second section 178 can be disposed on the portion of the first section 172 over the second area $A_2$ of the substrate 130.

One feature of the target 110 illustrated in FIGS. 2 and 3 is that the first sections 172 of the second ink layer 170, the second section 178 of the second ink layer 170, and the first ink layer 140 have different colors. An advantage of this feature is that the difference in color enables a shooter to clearly differentiate between the target image 112 and the field 120. The difference in color between the first ink layer 140 and the first sections 172 of the second ink layer 170 also provides a contrast so that the shooter can easily distinguish the different arcuate segments 118 of the target image 112. Another advantage of this feature is that the target 110 has a traditional bull's, eye configuration that is favored by some shooters.

Another feature of the illustrated target 110 illustrated in FIGS. 2 and 3 is that the synthetic and release layers 150 and 160 are positioned between the substrate 130 and the first and second sections 172 and 178 of the second ink layer 170. As a result, when a projectile strikes one of the target images 112, the portion of the corresponding first section 172 proximate to the impact point detaches and exposes the first ink layer 140. Moreover, when a projectile strikes the field 120, the portion of the second section 178 proximate to the impact point detaches and exposes the substrate 130. An advantage of this feature is that the target 110 enables a shooter to clearly identify his shot from a distance, even if the shot misses the target images 112 and strikes the field 120. As a result, the shooter does not need to walk to the target 110 and inspect the target 110 at close range after firing several rounds.

Another feature of the illustrated target 110 illustrated in FIGS. 2 and 3 is that the substrate 130 and the first ink layer 140 have different colors. Accordingly, if a shot strikes one of the target images 112, one color is exposed, and if a shot misses the target images 112 but strikes the field 120, a different color is exposed. An advantage of this feature is that the shooter can determine whether the shot struck one of the target images 112 based on the color exposed within the opening 171.

D. Additional Embodiments of Targets

Figure 4:
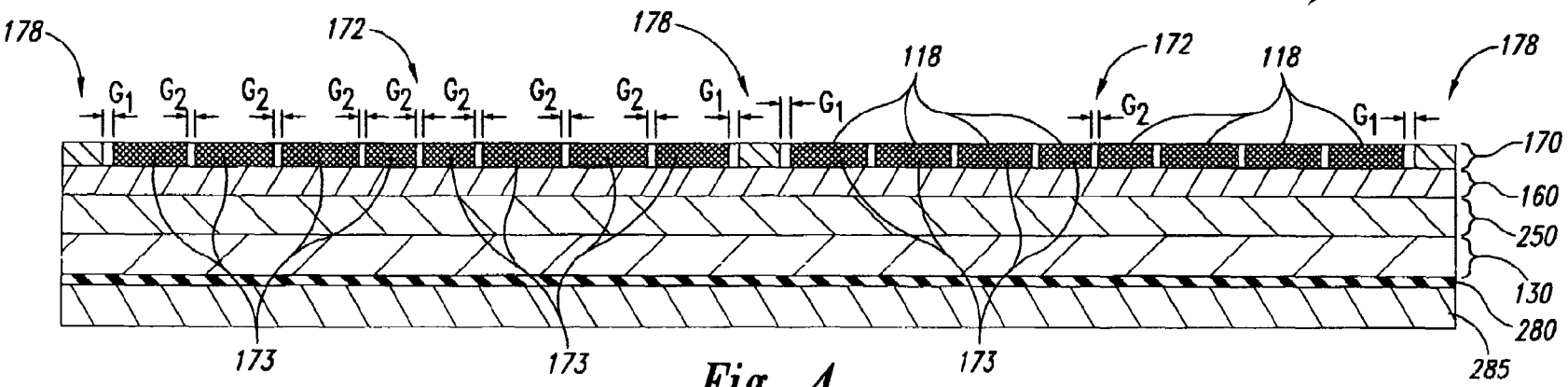
FIG. 4 is a schematic side cross-sectional view of a target in accordance with another embodiment of the invention.

FIG. 4 is a schematic side cross-sectional view of a target 210 in accordance with another embodiment of the invention. The target 210 is generally similar to the target 110 described above with reference to FIGS. 2 and 3. For example, the target 210 includes a substrate 130, a synthetic layer 250 on the substrate 130, a release layer 160 on the synthetic layer 250, and an ink layer 170 on the release layer 160. The illustrated target 210, however, does not include a second ink layer positioned between the substrate 130 and the release layer 160. As a result, portions of the substrate 130 are exposed through (a) the gaps $G_1$ between the first sections 172 and the second section 178 of the ink layer 170, and (b) the gaps $G_2$ between adjacent arcuate portions 173 of the individual first sections 172 of the ink layer 170. These exposed portions of the substrate 130 form the concentric rings and the cruciform of the target image. Moreover, other portions of the substrate 130 are exposed when portions of the first or second sections 172 or 178 of the ink layer 170 detach from the target 210. In other embodiments, the target 210 may include a second ink layer disposed between the substrate 130 and the release layer 160. In additional embodiments, the synthetic layer may not be transparent, but rather can be colored. In these embodiments, the colored synthetic layer is exposed through the gaps $G_1$ and $G_2$ and when portions of the ink layer 170 are removed.

The illustrated target 210 further includes an adhesive layer 280 formed on the substrate 130 opposite the synthetic layer 250, and a removable member 285 removably attached to the adhesive layer 280. The adhesive layer 280 is a pressure sensitive adhesive for selectively adhering the target 210 to the backing member 108 (FIG. 1) or other external surfaces. The removable member 285 can be selectively peeled or otherwise removed from the adhesive layer 280 before attaching the target 210. In additional embodiments, the target 210 may not include the adhesive layer 280 and the removable member 285.

Figure 5:
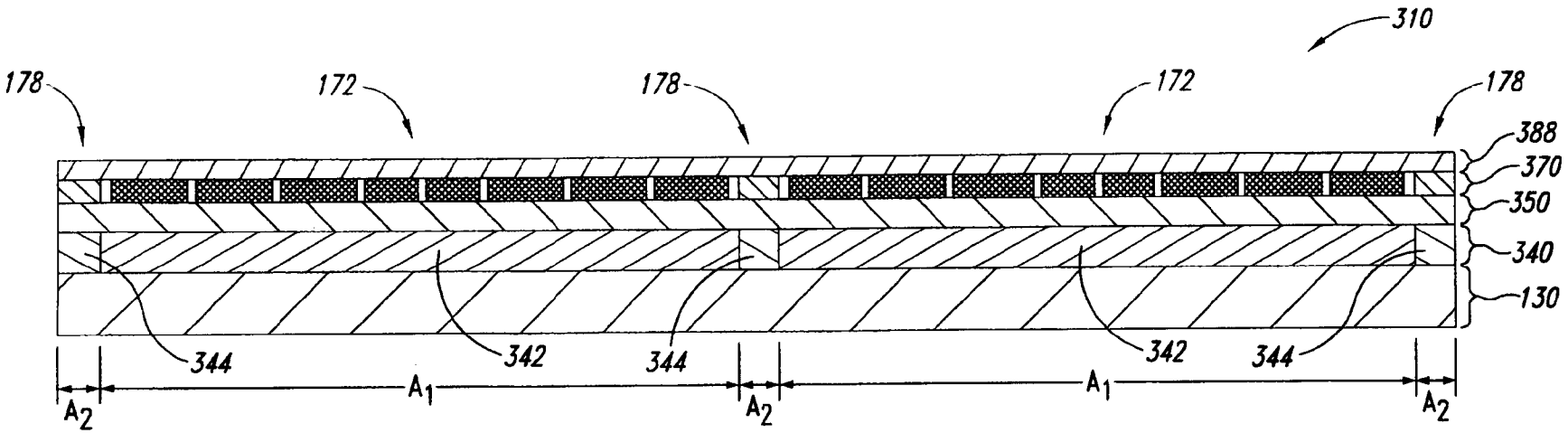
FIG. 5 is a schematic side cross-sectional view of a target in accordance with another embodiment of the invention.

FIG. 5 is a schematic side cross-sectional view of a target 310 in accordance with another embodiment of the invention. The illustrated target 310 is generally similar to the target 110 described above with reference to FIGS. 2 and 3. For example, the target 310 includes a substrate 130, a first ink layer 340 on the substrate 130, a synthetic layer 350 on the first ink layer 340, and a second ink layer 370 on the synthetic layer 350. The illustrated target 310, however, does not include a release layer between the first and second ink layers 340 and 370. Rather, the illustrated second ink layer 370 includes a release agent that inhibits the layer 370 from adhering to the target 310 so that fractured portions of the layer 370 detach from the target 310. In other embodiments, the target 310 may include a release layer between the first and second ink layers 340 and 370, and/or the second ink layer 370 may not include a release agent.

In the illustrated embodiment, the first ink layer 340 includes a plurality of first sections 342 aligned with corresponding first areas $A_1$ of the substrate 130 and a second section 344 aligned with the second area $A_2$ of the substrate 130. The first sections 342 have a first color, and the second section 344 has a second color different than the first color. As a result, when a projectile strikes the target image, one of the first sections 342 with the first color is exposed, and when a projectile strikes the field, the second section 344 with the second color is exposed. The shooter can accordingly determine whether his shot struck a target image based on the exposed color. In other embodiments, the first and second sections 342 and 344 can have the same color.

The illustrated target 310 further includes a protective layer 388 disposed over the second ink layer 370. The protective layer 388 protects the second ink layer 370 from scratching or other damage and inhibits accidental removal of the layer 370. In other embodiments, the target 310 may not include the protective layer 388.

Figure 6:
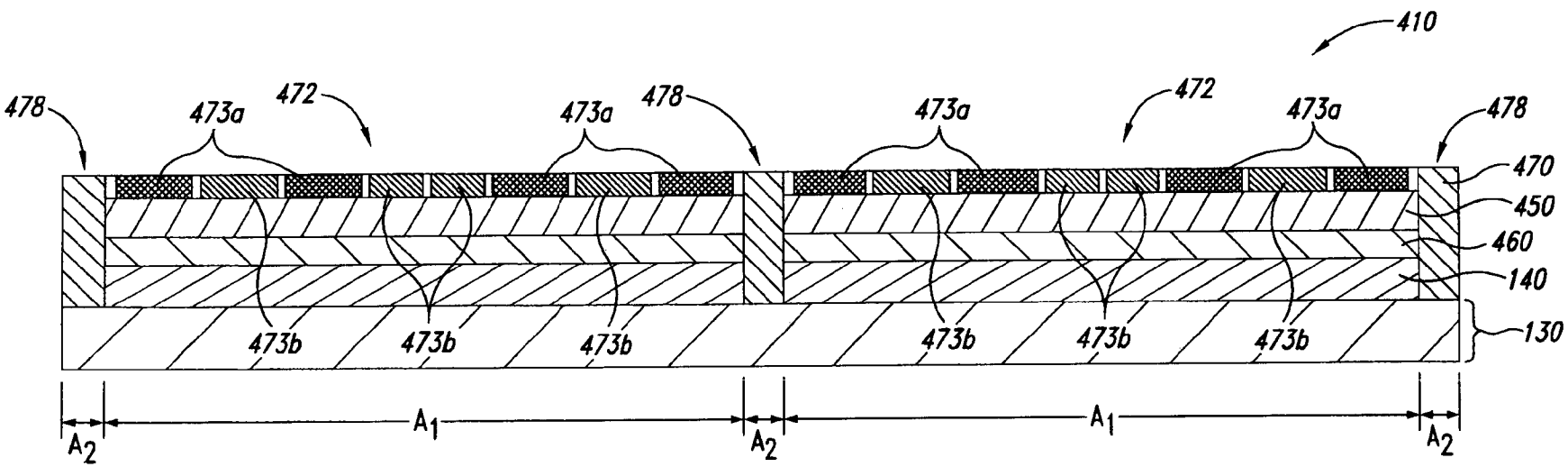
FIG. 6 is a schematic side cross-sectional view of a target in accordance with another embodiment of the invention.

FIG. 6 is a schematic side cross-sectional view of a target 410 in accordance with another embodiment of the invention. The target 410 is generally similar to the target 110 described above with reference to FIGS. 2 and 3. For example, the target 410 includes a substrate 130, a first ink layer 140, a synthetic layer 450, a release layer 460, and a second ink layer 470. In the illustrated target 410, however, the release layer 460 is positioned between the first ink layer 140 and the synthetic layer 450, and the synthetic and release layers 450 and 460 are disposed on only portions of the target 410. Specifically, the synthetic and release layers 450 and 460 are aligned with the first areas $A_1$ of the substrate 130 and do not cover the second area $A_2$ of the substrate 130.

The illustrated second ink layer 470 includes a plurality of first sections 472 aligned with corresponding first areas $A_1$ of the substrate 130 and a second section 478 aligned with the second area $A_2$ of the substrate 130. The individual first sections 472 include a plurality of first arcuate portions 473*a* and a plurality of second arcuate portions 473*b* arranged concentrically with the individual second arcuate portions 473*b* positioned between adjacent pairs of first arcuate portions 473*a*. The illustrated first and second arcuate portions 473*a-b* have different colors and form the arcuate segments of the target image. The second section 478 can have the same color as either the first or the second arcuate portions 473*a-b*. Alternatively, the second section 478 can have a different color than the first and second arcuate portions 473*a-b*. In either case, because the synthetic and release layers 450 and 460 are not positioned between the second section 478 and the substrate 130, the area around the point of impact is not expected to fracture and detach from the target 410 when a projectile strikes the second section 478 of the second ink layer 470.

E. Additional Embodiments of Target Images

Figure 7:
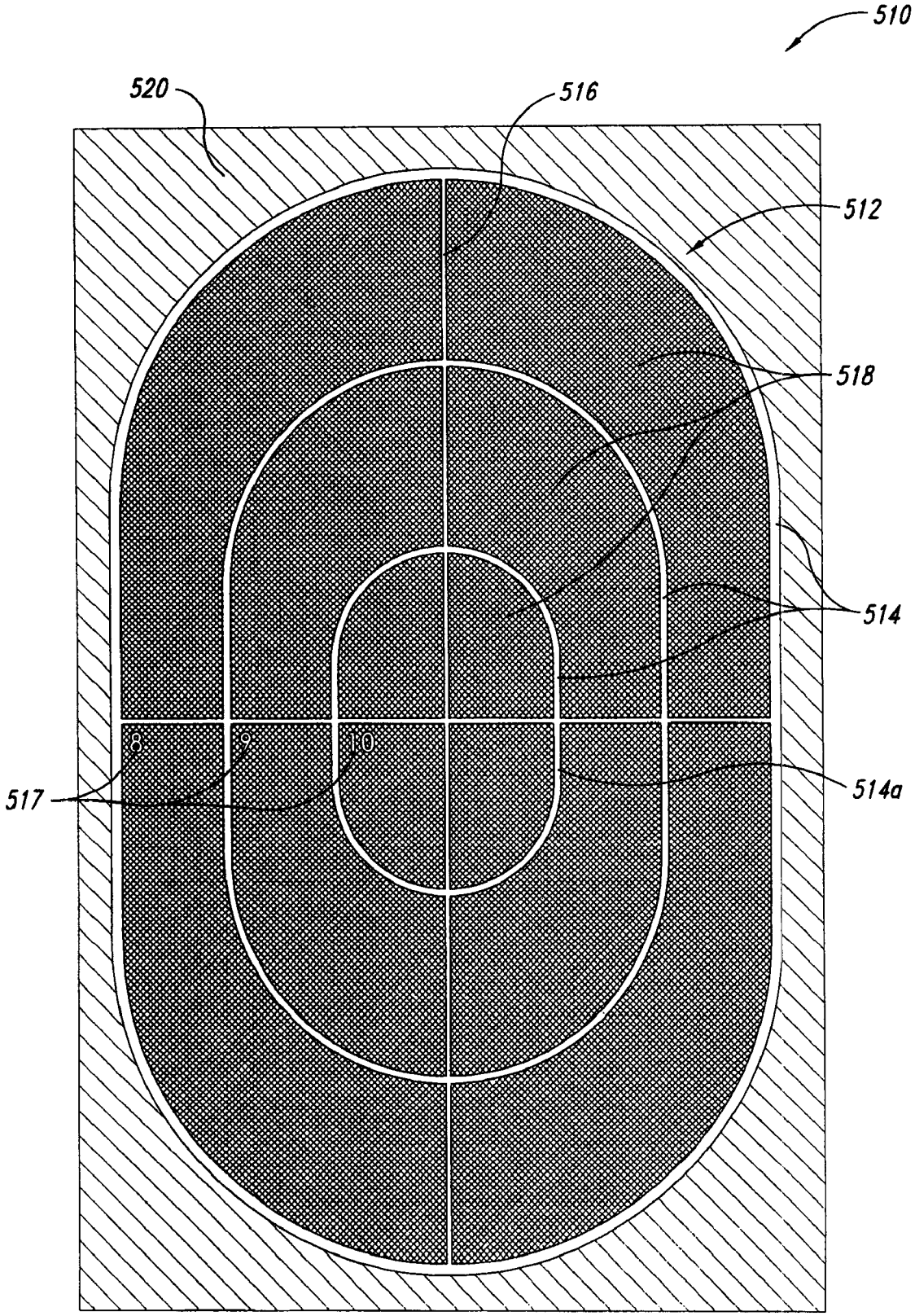
FIG. 7 is a schematic front view of a target in accordance with another embodiment of the invention.

FIG. 7 is a schematic front view of a target 510 in accordance with another embodiment of the invention. The target 510 is generally similar to the target 110 described above with reference to FIGS. 2 and 3. For example, the target 510 includes a target image 512 and a field 520 surrounding the target image 512. The illustrated target 510, however, includes a single target image 512 having a generally oval shape. The target image 512 includes a plurality of concentric rings 514, a cruciform 516 centered relative to the rings 514, a plurality of numbers 517 marking corresponding rings 514, and a plurality of arcuate segments 518 between adjacent rings 514 and between an inner ring 514*a* and the cruciform 516. In the illustrated embodiment, the concentric rings 514 and the cruciform 516 have a first color, the arcuate segments 518 have a second color different than the first color, and the field 520 has a third color different than the first and second colors. In other embodiments, the entire target image 512 can have a single color. In either case, the arcuate segments 518 and the field 520 are formed with an ink layer that is configured to partially detach when a projectile contacts the target 510. In additional embodiments, the target 510 can have more than one target image, and/or the target image can have a different configuration.

Figure 8:
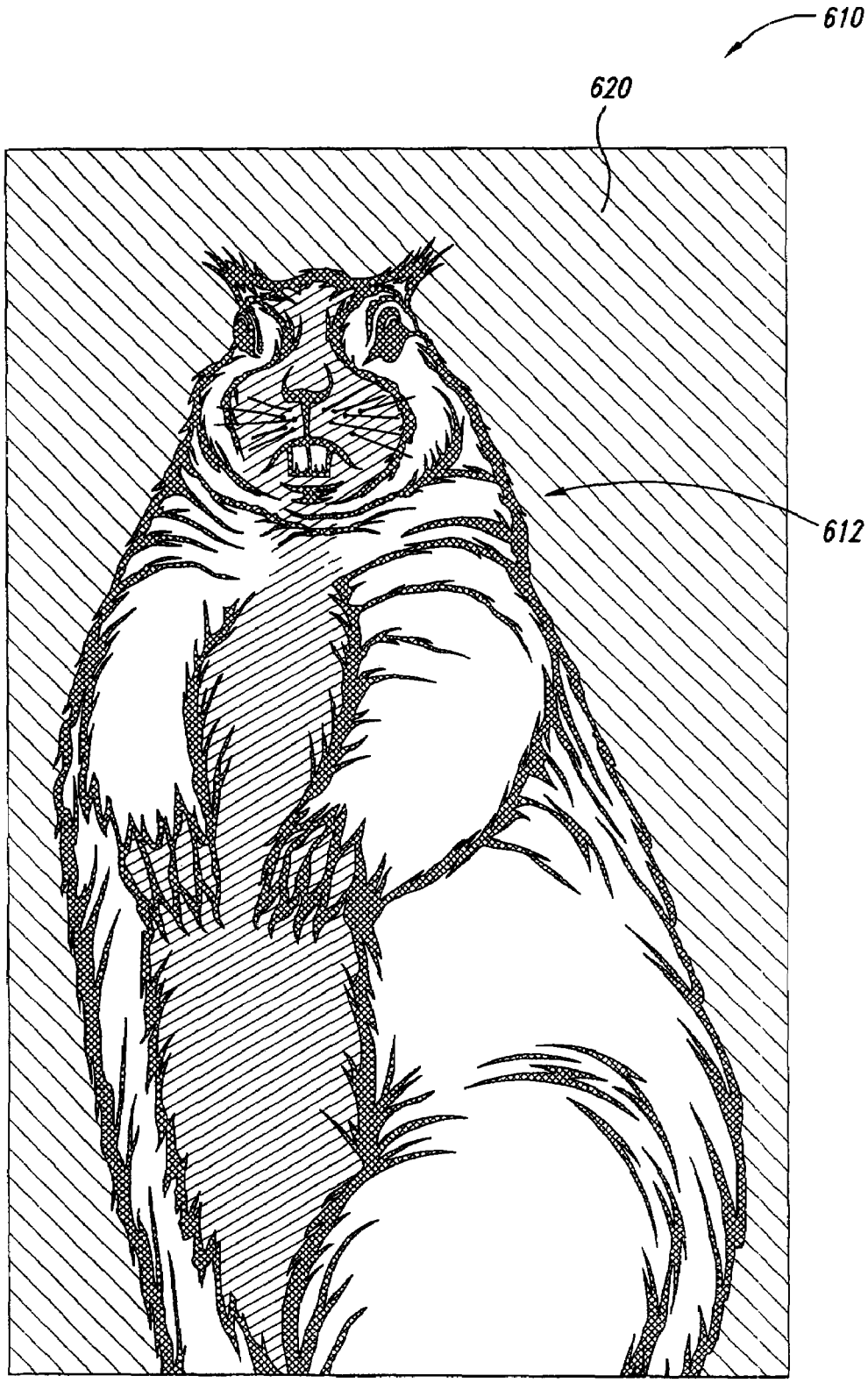
FIG. 8 is a schematic front view of a target in accordance with another embodiment of the invention.

FIG. 8 is a schematic front view of a target 610 in accordance with another embodiment of the invention. The target 610 is generally similar to the target 510 described above with reference to FIG. 7. For example, the target 610 includes a target image 612 and a field 620 surrounding a portion of the target image 612. The illustrated target image 612, however, does not include a bull's eye, but rather has a vermin. In the illustrated embodiment, the target image 612 has a first color defining the outline and contour of the vermin's body, a second color shading one portion of the vermin's body, and a third color shading another portion of the vermin's body. The illustrated field 620 has a fourth color different than the first, second, and third colors. In several applications, only the target image 612 is formed with an ink layer configured to partially detach when a projectile contacts the target 610. In other applications, the target image 612 and the field 620 are both formed with an ink layer configured to partially detach when a projectile contacts the target 610. In either case, the target image 612 may include a different animal or object in other embodiments.

From the foregoing, it will be appreciated that specific embodiments of the invention have been described herein for purposes of illustration, but that various modifications may be made without deviating from the spirit and scope of the invention. For example, many of the elements of one embodiment can be combined with other embodiments in addition to or in lieu of the elements of the other embodiments. Accordingly, the invention is not limited except as by the appended claims.

I claim:

1. A firearm target, comprising:

a substrate;

a first ink layer on the substrate;

a release layer on the first ink layer such that the first ink layer is positioned between the release layer and the substrate; and a second ink layer carried by the substrate, the second ink layer at least partially defining a target image and including (a) a first section having a first color and covering at least part of the first ink layer, and (b) a second section having a second color different than the first color, wherein the second ink layer is configured so that the impact of a firearm projectile detaches a portion of the second ink layer from the substrate and exposes a surface of the first ink layer and/or the substrate;

wherein the first section of the second ink layer comprises a plurality of spaced apart portions separated by gaps; and wherein the first ink layer is visible through the gaps.

2. The target of claim 1 wherein the second ink layer has a third color different than the first and second colors.

3. The target of claim 2 wherein the second ink layer has a fourth color different than the first, second, and third colors.

4. The target of claim 1 wherein the second section of the second ink layer is disposed outboard the target image.

5. The target of claim 1 wherein the first section of the second ink layer at least partially defines the target image and the second section of the second ink layer is disposed outboard the target image.

6. The target of claim 1 wherein the first section of the second ink layer comprises a plurality of discrete arcuate portions arranged concentrically.

7. The target of claim 1 wherein the substrate comprises an inorganic material.

8. The target of claim 1 wherein the substrate comprises mylar.

9. The target of claim 1 wherein the substrate comprises an organic material.

10. The target of claim 1 wherein:

the target image is a first target image;

the target further comprises a second target image spaced apart from the first target image; and the second section of the second ink layer is disposed between the first and second target images.

11. The target of claim 1, further comprising a synthetic layer between the release layer and the substrate.

12. A firearm target comprising:

a substrate;

a release layer on the substrate;

an ink layer on the release layer such that the release layer is positioned between the ink layer and the substrate, the ink layer at least partially defining a target image and having a first section with a first color and a second section with a second color different than the first color;

the subtrate includes a first area, a second area different than the first area, and a third color different than the first and second colors;

the ink layer comprises a first ink layer;

the target further comprises a second ink layer positioned between the substrate and the release layer;

the second ink layer covers the first area of the target and has a fourth color different than the first, second, and third colors;

the first section of the first ink layer covers at least a portion of the second ink layer and includes a plurality of discrete portions separated by gaps;

the gaps between adjacent portions of the first section of the first ink layer expose sections of the second ink layer; and the second section of the first ink layer covers the second area of the substrate.

13. A firearm target, comprising:

a substrate;

a first ink layer covering at least part of the substrate;

a second ink layer carried by the substrate, the second ink layer including (a) a first section having a first color and covering at least part of the first ink layer, and (b) a second section having a second color different than the first color, wherein the second ink layer is configured so that the impact of a firearm projectile detaches a portion of the second ink layer from the substrate and exposes a surface of the first ink layer and/or the substrate;

wherein the first section of the second ink layer comprises a plurality of spaced apart portions separated by gaps; and wherein the first ink layer is visible through the gaps.

14. The target of claim 13 wherein the second ink layer comprises a release agent.

15. The target of claim 13, further comprising a release layer between the first ink layer and the second ink layer.

16. The target of claim 13 wherein the first ink layer comprises a first section having a third color and a second section having a fourth color different than the third color.

* * * * *

UNITED STATES PATENT AND TRADEMARK OFFICE

CERTIFICATE OF CORRECTION

PATENT NO. : 7,631,877 B2
APPLICATION NO. : 11/339863
DATED : December 15, 2009
INVENTOR(S) : Robert Joseph Zara It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 522 days.

Signed and Sealed this

Second Day of November, 2010

David J. Kappos

David J. Kappos
*Director of the United States Patent and Trademark Office*